United States Patent [19]

Bolt et al.

[11] 4,020,382

[45] Apr. 26, 1977

[54] LAMP HAVING SCREW BASE

[75] Inventors: Barry Bolt, Howell; Petrus Peters, Cranbury, both of N.J.

[73] Assignee: North American Philips Corporation, New York, N.Y.

[22] Filed: Dec. 19, 1975

[21] Appl. No.: 642,388

[52] U.S. Cl. ..... 313/318; 313/315; 339/144 R; 339/146

[51] Int. Cl.[2] ..... H01J 5/48; H01J 5/50

[58] Field of Search ..... 313/315, 317, 318; 339/144 R, 146

[56] References Cited

UNITED STATES PATENTS

| | | | |
|---|---|---|---|
| 1,439,471 | 12/1922 | Hohl | 313/318 |
| 1,577,151 | 3/1926 | Abelt, Jr. | 313/318 X |
| 1,650,289 | 11/1927 | McGinley | 313/318 |
| 2,159,812 | 5/1939 | Malloy | 339/146 |
| 3,162,502 | 12/1964 | Verbeek | 313/317 X |
| 3,265,922 | 8/1966 | Verbeek | 313/318 |
| 3,551,725 | 12/1970 | Brundige | 313/318 |

*Primary Examiner*—Saxfield Chatmon, Jr.
*Attorney, Agent, or Firm*—Frank R. Trifari; George B. Berka

[57] ABSTRACT

A glass screw base of a bulb is provided with a first channel for accomodating solder filling used for mechanical locking of the glass base to a metal screw shell. A second, narrow channel is made in the base to receive a lead wire and direct it to the rim of the shell whereupon an electrical contact is established by a minimal amount of solder and solder flux.

2 Claims, 3 Drawing Figures

PRIOR ART

LAMP HAVING SCREW BASE

This invention relates generally to lamp structure such as for example, incandescent lamps and gas discharge lamps having a glass bulb and a threaded lamp base. More particularly, this invention relates to an improved screw base where a metal screw shell of the base is screwed directly on a threaded glass base portion of the bulb. Glass screw bases have the advantage that the cement, which can give many problems in overheated fittings, can be omitted.

In conventional constructions of a lamp screw base, the electrical contact to the metal screw shell is made by bending one lead-in wire up the side of the base portion of the bulb before the screw shell is screwed on, and then the end of the wire is soldered to the shell. In order to prevent wire from being crushed and weakened, and to insure a securely fitting base, an upward channel is made in the glass base portion for the wire to fit in. The thread is molded into the glass during the lamp sealing operation. Furthermore, in order to prevent the metal screw base from becoming unscrewed during use, this channel is made sufficiently deep so that solder deposited in it locks the base in place as well as it makes the electrical contact. The disadvantage of this prior art construction resides in the fact that a considerable amount of solder is pushed down into the interspace of the base and to within a comparatively short distance of the pressed glass stem. Since the lead wires of the lamp consist usually of strands of nickel plated copper which are butt welded to tungsten wires and which are sealed into the stem press, the process of butt welding and of press sealing tend to oxidize and weaken the stranded wire at and near the weld. It has been found that the flux or corrosive substances contained in, or used with, solder travels also along the sealed lead wires and attacks them in the region of the stem press, thereby causing premature lamp failure.

It is, therefore, an object of this invention to avoid the above drawback of prior art lamp base constructions and to provide a lamp screw base in which the flux of corrosive solder components has no possibility to pass to the vulnerable part of the lead-in wire.

According to this invention, the above objects are obtained by providing the threaded glass base portion of the lamp bulb with a second much narrower channel so that the lead-in wire just fits into it. Upon screwing on the metal screw shell, electrical contact is made by using a minimum amount of solder and flux at the top of the base shell whereby the larger channel is filled with solder for mechanical locking only.

The foregoing and other objects of the invention will be best understood from the following description of an examplification thereof, reference being had to the accompanying drawing wherein.

Figure 1:
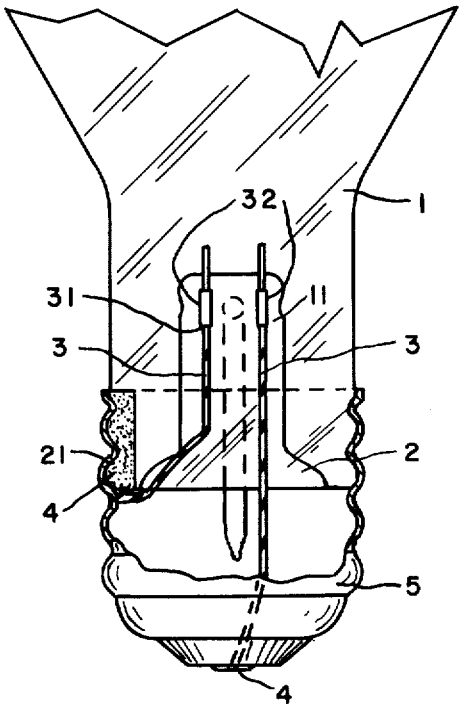
FIG. 1 is an illustration of prior art screw base construction.

Referring now to the figures, a glass bulb 1 of the lamp includes a glass mount in the form of a stem press 11 and a glass screw base portion 2 upon which as mentioned above a metal screw shell 5 (shown in a partly cut-away view), is directly screwed on. The lead wires 3 usually made of strands of nickel plated copper, are butt welded to tungsten wires 32 and the tungsten is sealed into the glass stem press 11. The region at and near the weld 31 is susceptible to failure since the process of butt welding and of press sealing tends to oxidize and weaken the copper strands. In the conventional construction as shown in FIG. 1, the single, relatively broad and deep channel 21 in the glass base portion 2 receives the end portion of one wire 3 and is subsequently filled with solder 4 to provide both mechanical locking of the metal screw shell 5 and an electrical contact between the wire 3 and the shell 5. Since the solder 4 contains, or is used with, corrosive flux, the flux during the solder operation travels along the wires 3 as far as to the weld region 31 and contributes to additional corrosion of this weak spot.

Figure 2:
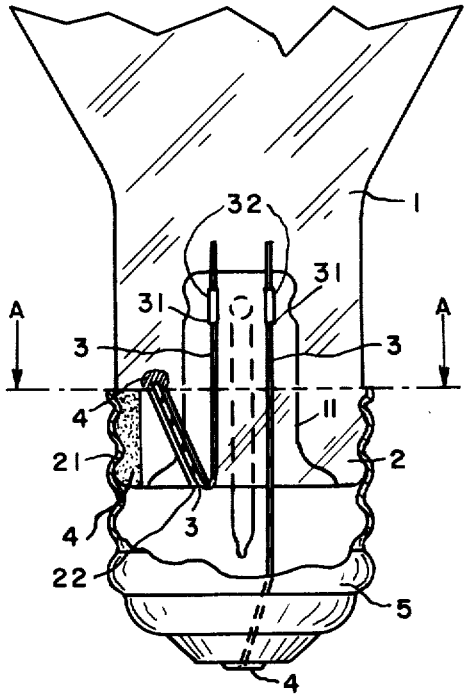
FIG. 2 is screw base structure according to the invention.
Figure 3:
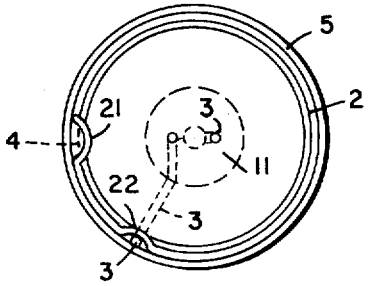
FIG. 3 is a sectional view taken along the line A—A in FIG. 2.

In the embodiment according to the invention as shown in FIG. 2, the amount of the corrosive flux during soldering is reduced and the path length which it has to travel is increased by providing in the glass base portion 2 an additional channel 22 which is much narrower than the first channel 21 so that the wire 3 just fits into it. Electrical contact is established by using a minimum amount of solder and flux 4 at the rim of the metal screw shell 5. The larger first channel 21 is filled with solder 4 for mechanical locking similarly as in the prior art lamp, but the corrosive flux has now no path to the vulnerable part 31 of the lead wire 3.

I wish it to be understood that I do not desire to be limited to the exact details of construction and described, for obvious modifications will occur to a person skilled in the art.

Having the described invention, what I claimed as new and desire to be secured by Letters Patent, is as follows:

1. A lamp including a glass bulb having a stem press with sealed-in lead wires, a glass screw base portion and a metal screw shell screwed on the base portion, comprising in said base portion, a first channel extending across the glass threads, said first channel being relatively deep and broad to receive a sufficient amount of solder filling for mechanical locking of the screw shell, a second channel extending across the glass threads and accomodating one lead wire so that the wire tightly fits into it, and an electrical contact provided by soldering the end of said one lead wire to the rim of said shell.

2. A lamp as claimed in claim 1, wherein said first channel extends along a shortest path between the top and the bottom of said base portion, whereas said second channel is inclined with respect to the first channel to increase the path length which the solder flux has to travel.

* * * * *